US006150981A

United States Patent [19]

Suguro et al.

[11] Patent Number: 6,150,981

[45] Date of Patent: Nov. 21, 2000

[54] PLANE ANTENNA, AND PORTABLE RADIO USING THEREOF

[75] Inventors: Akihiro Suguro, Kanagawa; Takahito Morishima, Shiga, both of Japan

[73] Assignee: Kyocera Corporation, Kyoto, Japan

[21] Appl. No.: 09/070,211

[22] Filed: Apr. 30, 1998

[51] Int. Cl.[7] ..... H01Q 1/38

[52] U.S. Cl. ..... 343/700 MS; 343/846; 343/895

[58] Field of Search ..... 343/700 MS, 829, 343/830, 846, 895; H01Q 1/38, 21/00

[56] References Cited

U.S. PATENT DOCUMENTS

| | | | |
|---|---|---|---|
| 4,191,959 | 3/1980 | Kerr | 343/700 MS |
| 4,866,451 | 9/1989 | Chen | 343/700 MS |
| 5,594,455 | 1/1997 | Hori et al. | 343/700 MS |

FOREIGN PATENT DOCUMENTS

| | | | |
|---|---|---|---|
| 0450881 | 3/1991 | European Pat. Off. | H01Q 9/04 |
| 2224506 | 9/1990 | Japan | H01Q 21/00 |
| 6310930 | 4/1994 | Japan | H01Q 5/00 |
| 7154137 | 6/1995 | Japan | H01Q 21/30 |
| 2272575 | 5/1994 | United Kingdom | 343/700 MS |
| 9740548 | 10/1997 | WIPO | H01Q 21/29 |

*Primary Examiner*—Don Wong
*Assistant Examiner*—Tho Phan
*Attorney, Agent, or Firm*—Hogan & Hartson, LLP

[57] ABSTRACT

Of four sides of a quadrilateral conductor to be used as a radiating element, at least three sides are made different in length from each other.

5 Claims, 5 Drawing Sheets

PLANE ANTENNA, AND PORTABLE RADIO USING THEREOF

BACKGROUND OF THE INVENTION

The present invention relates to the field of communication, and more particularly, to the impedance matching and adjustment of a multiple-resonance frequency of a circularly-polarized plane antenna used for satellite communication. Further, the present invention relates to a portable radio employing a circularly-polarized plane antenna.

The concept of a portable cellular phone using satellites has recently been proposed by various corporations. With regard to frequency bands used for the portable cellular phone, a frequency band of 1.6 GHz is assigned to up-link communications from a ground portable cellular phone to a communications satellite, and a frequency band of 2.4 GHz is assigned to down-link communications from the communications satellite to the ground portable cellular phone. The frequency band of 1.6 GHz is also assigned to bi-directional communications between ground stations and the communications satellite. A circularly-polarized wave is commonly used in the communications in order to ensure the quality of a communications circuit.

A plane antenna has already been in actual use which receives a radio wave (e.g., a circularly-polarized right-turn wave of 1.5 GHz) transmitted from a Global Positioning System (GPS) satellite. The plane antenna is a one-point back feeding microstrip antenna (MSA) comprising a plate-like dielectric substance, a patch conductor (i.e., a radiation element) labeled to one side of the plate-like dielectric substance, and a ground conductor labeled to the other side of the plate-like dielectric substance. FIG. 5 is a view showing an existing one-point back feeding microstrip antenna (MSA) 21 when viewed from directly above, and a patch-shaped conductor 21*b* has a rectangular parallelepiped shape. Taking the length of longer sides PO and QR of a patch conductor 21*b* as L and the length of shorter sides PQ and OR of the patch conductor 21*b* as S, the conductor is set such that 100×L/S=102 to 103% or thereabouts. The longer sides PO and QR produce resonance at comparatively low frequencies and demonstrate an elliptically-polarized wave. In contrast, the shorter sides PQ and OR produce resonance at comparatively higher frequencies and demonstrate another elliptically-polarized wave orthogonal to the previously-described elliptically-polarized wave. The patch conductor acts as a circular polarization antenna between the foregoing frequencies.

To connect an electric feed line having a characteristic impedance of 50 Ω a feed pin 21*a* (from behind), the impedance of the electric feed line is matched to that of the feed pin by adjusting the position of the feed pin 21*a*. More specifically, it is known that all you have to do is to place the feed pin 21*a* in any position along substantially-diagonal lines of a square.

A dielectric substrate 21*c* forming the MSA 21 has already been in actual use in the form of a dielectric substrate having a dielectric constant of about 20, a thickness of 4 to 6 mm, and a size of about 25 mm. A GPS requires a very narrow bandwidth of the order of about 1 MHz.

In contrast, since a satellite portable cellular phone performs transmission and receipt of a signal in a comparatively broader bandwidth of the order of about 10 MHz, the thickness of the dielectric substrate 21*c* must be increased to thereby comparatively broaden the bandwidth. Further, in a system employing a low orbiting satellite, there is a need to ensure the gain of an antenna at a low elevation angle.

However, in a case where the dielectric substrate is increased (so as to become about twice as thick as an existing GPS MSA) with a view to improving the characteristics of the antenna in a bandwidth or at a low elevation angle, it is difficult for a rectangular patch conductor to simultaneously satisfy a desired multiple resonance frequency and impedance matching.

SUMMARY OF THE INVENTION

The present invention solves the foregoing problem by the means described in the appended claims of the present patent specification. More specifically, the present invention provides a microstrip plane antenna which includes a plate-like dielectric substance, a patch conductor provided on one side of the dielectric substance, and a ground conductor provided on the other side of the dielectric substance and which feeds electric power to the patch conductor by means of a back feeding method, the improvement being characterized by the feature that the patch conductor has a square shape and at least three different-sized sides.

DETAILED DESCRIPTION OF THE PREFERRED EMBODIMENTS

Figure 1:
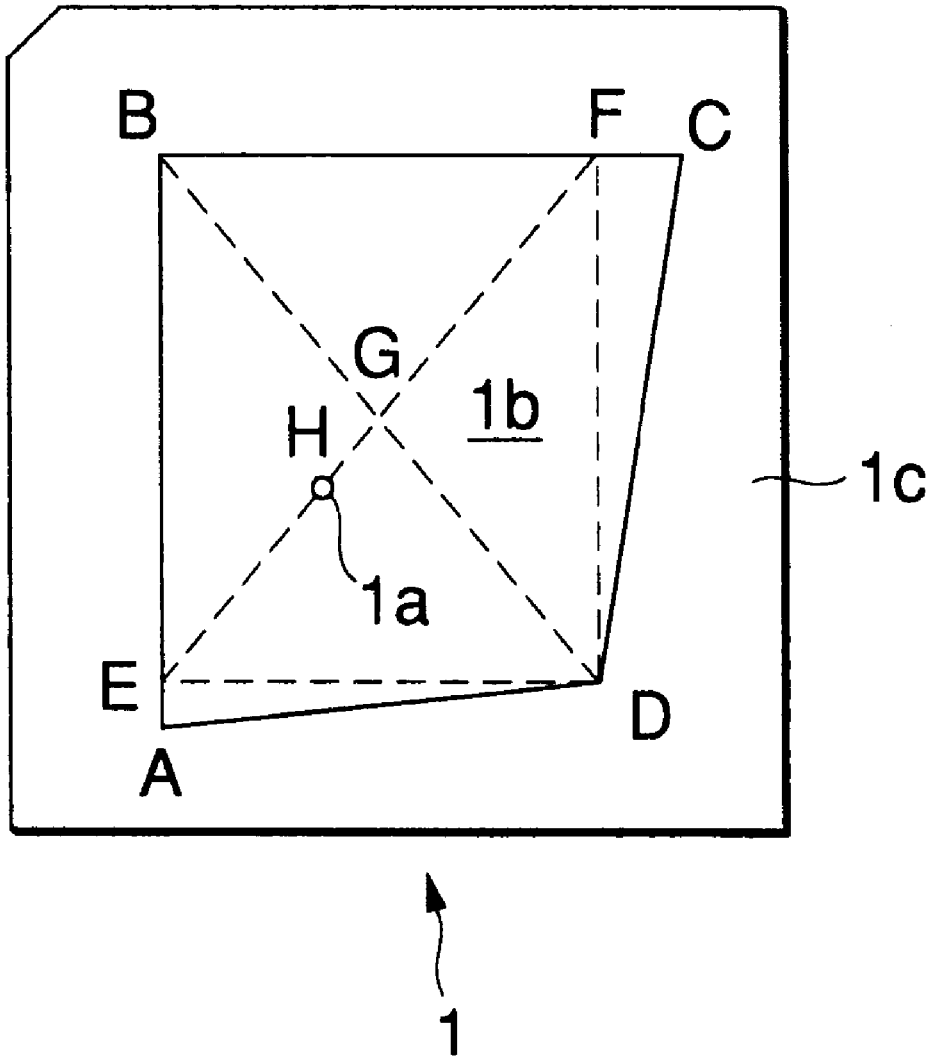
FIG. 1 is a schematic representation showing a one-point back feeding microstrip plane antenna in accordance with an embodiment of the present invention when viewed from above.

FIG. 1 is a schematic representation showing the configuration of a plane antenna in accordance with an embodiment of the present invention. In the drawing, reference numeral 1 designates a microstrip plane antenna (MSA); 1*a* designates a feeding pin; 1*b* designates a patch conductor; and 1*c* designates a dielectric substrate. An unillustrated ground conductor is connected to the reverse side of the dielectric substrate 1*c*, and the feed pin 1*a* passes through a through hole formed in the ground conductor from behind in a non-contact manner and is connected to a feeding point H of the patch conductor 1*b*. A first side of the patch conductor 1*b* is taken as (side AB), a second side of the same is taken as (side BC). A third side of the patch conductor 1*b* is taken as (side CD), and a fourth side of the same is taken as (side DA).

Figure 2A:
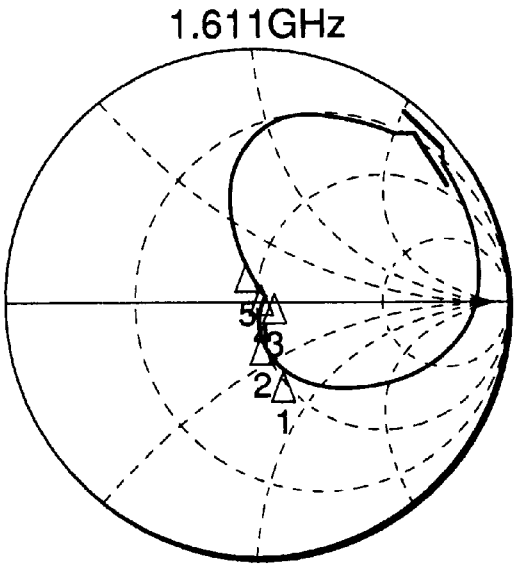
FIGS. 2A and 2B are Smith charts showing examples of measurement of the microstrip plane antenna according to the present invention.
Figure 2B:
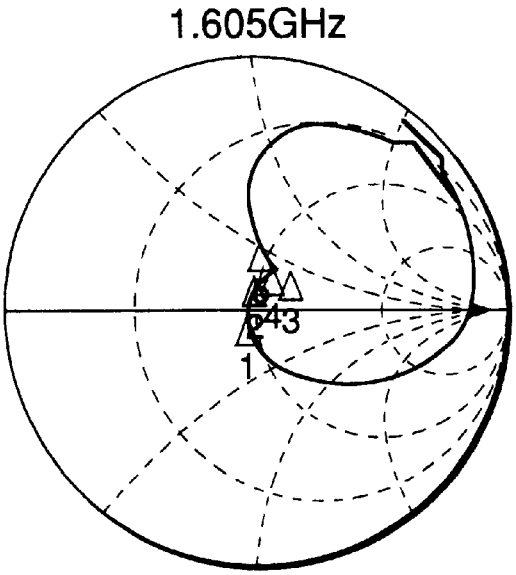

In the present embodiment of the invention, a rectangle EBFD is initially formed, and a point of intersection of diagonal line EF and diagonal line BD is taken as G. Point H is placed as a feeding point along line segment EG in order to produce a circularly-polarized right-turn wave. In addition, with a view to facilitating the adjustment of a multiple resonance frequency and impedance matching, the side EB is extended to side A, and the side BF is extended to side B (where AB≠BC). As a result of these sides being extended, the sides CD and DA become oblique lines. Consequently, the feasible distances from the feeding point H to the sides are increased. In short, the bandwidth of the patch conductor 1*b* is also increased, and the conditions for impedance matching determined by the distances from the feeding point H to the sides are alleviated. FIG. 2 shows an example of measurement of the MSA1. FIGS. 2A and 2B are examples of measurement of a trapezoidal patch conductor represented by ABFD which results from extension of side EB of the rectangle designated by EBFD shown in FIG. 1. FIG. 2A is a Smith chart obtained in a case where the extension (i.e., side AE) of the patch conductor is set to 1.5 mm in length, whilst FIG. 2B is a Smith chart obtained in a case where the extension (i.e., the side AE) is set to 2.0 mm in length.

Figure 3:
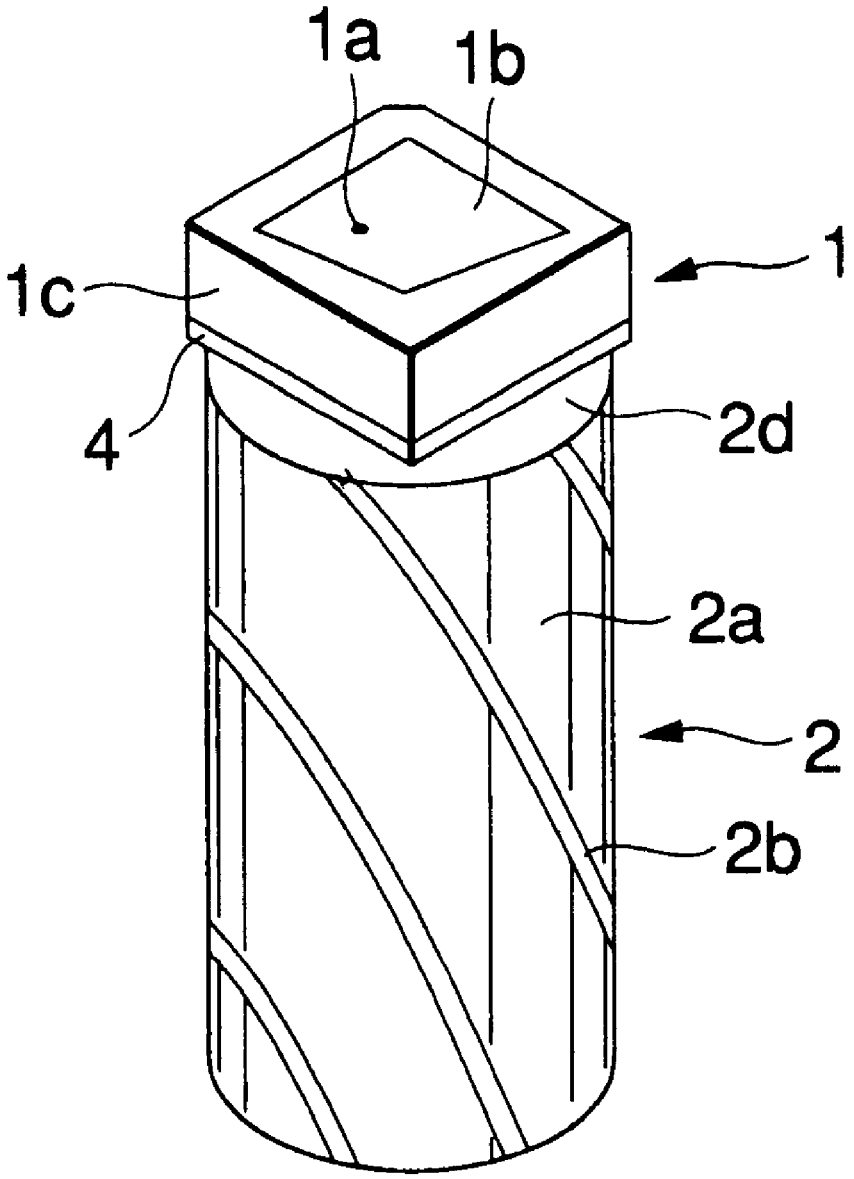
FIG. 3 is a schematic representation showing the microstrip plane antenna according to the present invention when used in combination with a four-wire helical antenna.

Taking the sides AB, BC, CD, and DA of the patch conductor 1*b*, respectively, as 20 mm, 19 mm, 18.6 mm, and 17.04 mm, as well as taking the dielectric substrate 1*c* as having a thickness of 12 mm, a dielectric constant of about 20, and an outer size of 28 mm×28 mm, the patch conductor 1*b* and a helical antenna 2 are used in combination, as shown in FIG. 3. FIG. 3 shows a ground conductor 4, and the helical antenna 2 is connected to a lower portion of the ground conductor 4 in a coaxial direction thereof. The helical antenna 2 comprises an acrylic cylinder (or a dielectric pole) having a diameter of 30 mm, four copper foil tapes (or linearly-radiated elements) 2*b* which have a width of 4.5 mm and are helically wrapped on the surface of the acrylic cylinder over a height of 134 mm through 180°; and the copper foil tapes 2*b* that stand opposite to each other at the lower end of the acrylic cylinder and are electrically connected together by means of sheathed wires. The intersection between the sheathed wires at the lower end of the acrylic cylinder does not result in DC coupling. Although the MSA 1 is mounted on the upper end of the acrylic cylinder 2*a*, the copper foil tapes 2*b*, which serve as linearly-polarized helical radiating elements, are not directly connected to the ground conductor 4. A marginal portion (a conductor) 2*d* having a width of about 7 mm is connected between the ground conductor 4 and the copper foil tapes 2*b* and is electrically connected to the helical radiating elements. A coaxial cable (or a signal transmission path) 6 is connected to the feed pin 1*a* that passes through a through hole 4*a* formed in the ground conductor 4 by way of the inside of the acrylic cylinder 2*a*, thereby feeding electric power to the patch conductor 1*b*. In the present embodiment, the gain of the antenna at a low elevation angle is improved when compared with the gain of an antenna employing only the MSA 1. An antenna is configured which has uniform directivity in substantially every direction from a low elevation angle to the zenith and superior axial ratio.

Figure 4:
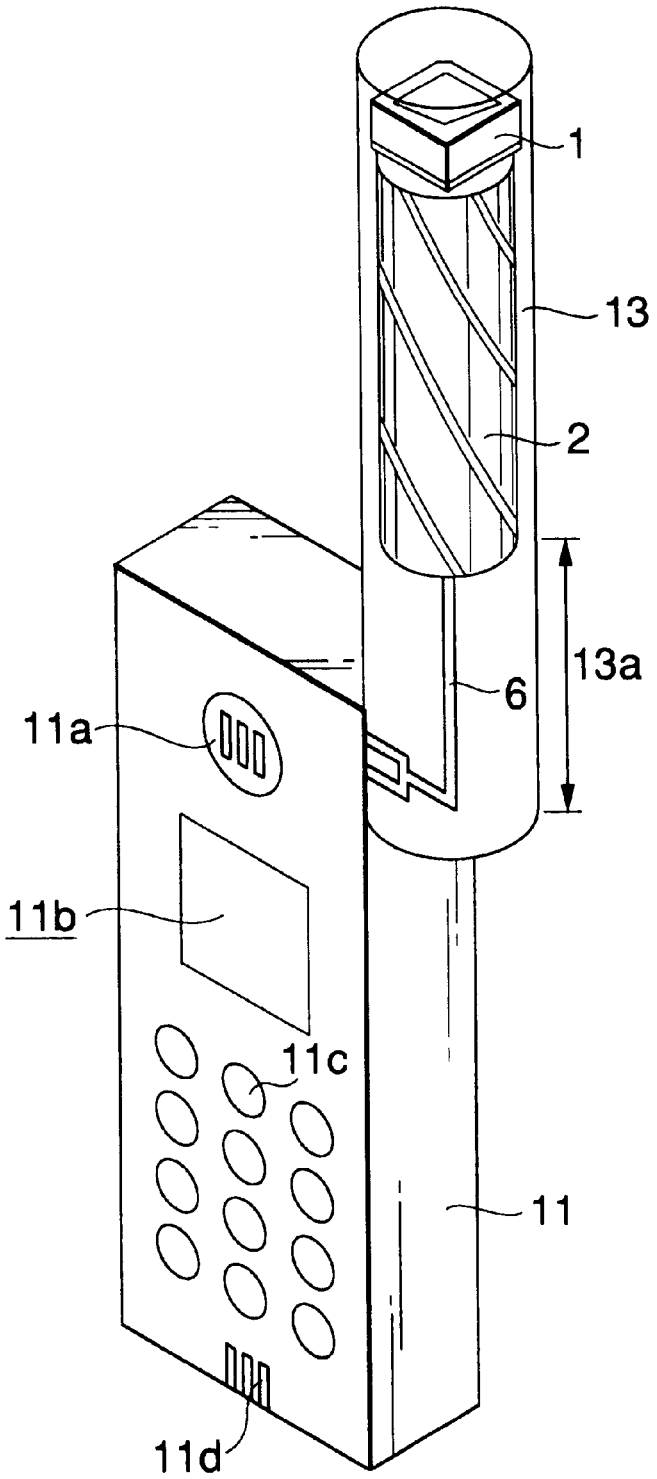
FIG. 4 is a schematic representation showing a portable radio having the antenna shown in FIG. 3.
Figure 5:
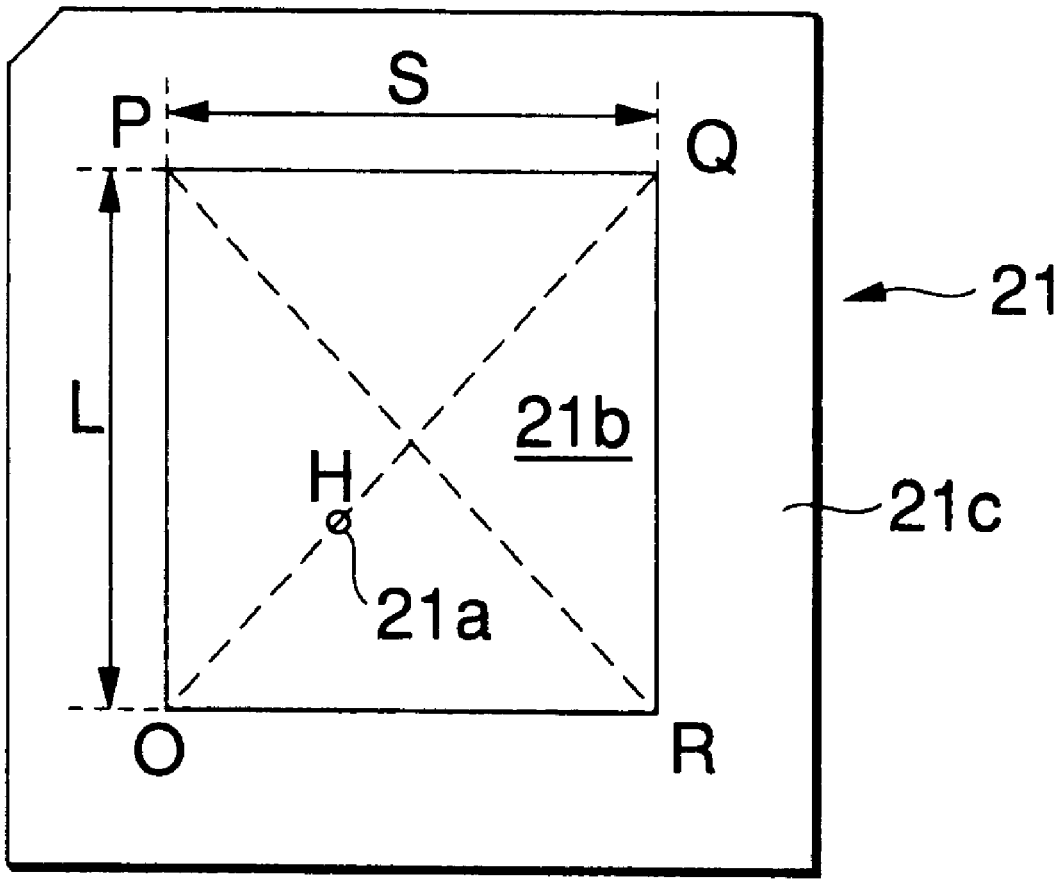
FIG. 5 is a plan view showing an existing back feeding microstrip plane antenna when viewed from above.

FIG. 4 shows a portable radio (or a portable cellular phone) having the antenna shown in FIG. 3. The helical antenna 2 is supported by an antenna support cylinder 13 and is spaced away from a portable radio 11 in a longitudinal direction with a communication section 13*a* provided between them. In the portable radio 11, reference numeral 11*a* designates a receiving section; 11*b* designates a display; 11*c* designates an operation section; and 11*d* designates a transmitting section. As a result of the portable radio having the antenna shown in FIG. 3, it becomes feasible for the portable radio to establish communications with a low orbiting satellite in the direction of the zenith through use of one antenna.

As has been described above, even when a patch conductor to be used as a radiating element is formed on a dielectric substrate having a comparatively large thickness, the present invention enables the adjustment of a desired multiple resonance frequency and the impedance matching between a feed line and a feed pin to be satisfied simultaneously. Further, it goes without saying that the present invention can also be applied to an antenna having a dielectric substrate of comparatively small thickness such as an existing dielectric substrate. In the case of a plane antenna which has a high dielectric constant and requires sever dimensional accuracy for a patch conductor, the present invention yields pronounced effects.

What is claimed is:

1. A microstrip plane antenna comprising:

a dielectric substrate plate, a patch conductor provided on one side of said dielectric substrate plate, and a ground conductor provided on the other side of said dielectric substrate plate and which feeds electric power to said patch conductor by means of a back feeding method, wherein said patch conductor has a quadrilateral shape and at least three different-sized sides.

2. The microstrip plane antenna of claim 1, further comprising:

a helical antenna which is electrically connected to a lower portion of said ground conductor of said plane antenna.

3. The microstrip plane antenna of claim 1, wherein said dielectric substrate plate has a dielectric constant of about 20, a thickness of 4 to 6 mm, and a size of about 25 mm.

4. A portable radio comprising:

a microstrip plane antenna which includes a dielectric substrate plate, a quadrilateral patch conductor provided on one side of said dielectric substrate plate, and a ground conductor provided on the other side of said dielectric substrate plate and which feeds electric power to said patch conductor by means of a back feeding method, wherein said quadrilateral patch conductor has at least three different-sized sides; and a helical antenna electrically connected to a lower portion of said plane antenna.

5. The microstrip antenna of claim 4, wherein said dielectric substrate plate has a dielectric constant of about 20, a thickness of 4 to 6 mm, and a size of about 25 mm.

* * * * *